United States Patent [19]

Takahashi et al.

[11] Patent Number: 4,977,639

[45] Date of Patent: Dec. 18, 1990

[54] FLOOR DETECTOR FOR VACUUM CLEANERS

[75] Inventors: Yutaka Takahashi; Yoshihiro Noguchi; Takahiro Yanagida; Tomohisa Imai, all of Saitama, Japan

[73] Assignees: Mitsubishi Denki Kabushiki Kaisha, Tokyo; Mitsubishi Electric Home Appliance Co., Ltd., Saitama, both of Japan

[21] Appl. No.: 392,897

[22] Filed: Aug. 14, 1989

[30] Foreign Application Priority Data

| | | | |
|---|---|---|---|
| Aug. 15, 1988 | [JP] | Japan | 63-201942 |
| Aug. 15, 1988 | [JP] | Japan | 63-201943 |
| Aug. 15, 1988 | [JP] | Japan | 63-201944 |
| Aug. 15, 1988 | [JP] | Japan | 63-201945 |
| Aug. 15, 1988 | [JP] | Japan | 63-201947 |
| Aug. 15, 1988 | [JP] | Japan | 63-201948 |

[51] Int. Cl.[5] ..... A47L 9/28

[52] U.S. Cl. ..... 15/319; 15/339

[58] Field of Search ..... 15/319, 339

[56] References Cited

U.S. PATENT DOCUMENTS

| | | | |
|---|---|---|---|
| 4,342,132 | 8/1982 | Fromknecht | 15/339 |
| 4,654,924 | 4/1987 | Getz et al. | 15/319 |
| 4,754,520 | 7/1988 | Steadings et al. | 15/319 |

FOREIGN PATENT DOCUMENTS

| | | | |
|---|---|---|---|
| 3229754 | 2/1984 | Fed. Rep. of Germany | 15/339 |
| 3241213 | 5/1984 | Fed. Rep. of Germany | 15/339 |
| 58-17588 | 4/1983 | Japan . | |

*Primary Examiner*—Henry J. Recla
*Assistant Examiner*—Robert M. Fetsuga
*Attorney, Agent, or Firm*—Burns, Doane, Swecker & Mathis

[57] ABSTRACT

A floor detector for a power brush of a vacuum cleaner comprises a lift sensor S1 and a floor sensor S2. The lift sensor S1 has a movable member which yieldably displaces when the power brush is placed on a relatively soft floor while the floor sensor S2 has a movable member which yieldably displaces when the power brush is placed on a relatively hard floor. Each of movable members is detected its movement by a corresponding light sensor which provides a signal representative of the movements. The signals from the light sensors are sent to a control circuit which controls a drive source for driving the brush member of the power brush. In this manner, the brush member is rotated when the power brush is placed on a relatively soft floor such as a carpeted floor and is not rotated when the power brush is placed on a relatively hard, flat, smooth floor.

8 Claims, 11 Drawing Sheets

FLOOR DETECTOR FOR VACUUM CLEANERS

BACKGROUND OF THE INVENTION

1. Field of the Invention

The present invention relates to improvements of the power brush of a vacuum cleaner which is provided with the power brush.

2. Prior Art

Accessories for home cleaners include a nozzle with a round brush and a narrow air suction opening for use in narrow places, and a floor brush exclusively used for floor cleaning with a wide air suction opening at the bottom. In recent years, as the use of carpets has been common in ordinary houses, more and more home vacuum cleaners have come to be equipped with power brushes to clean carpeted floors. A power brush in which a floor brush is driven by a built-in motor is well known. As is known, a panel floor forms a relatively flat, hard floor surface while a carpeted floor that is made of fibers has a floor surface having portions resiliently recessed and raised, forming a relatively soft floor surface.

FIG. 14 shows a top cross-sectional view of a prior art power brush and FIG. 15 illustrates a side view of the prior art power brush when it is placed on a floor 7.

At the bottom of a casing 1 facing the floor surface is provided an air suction opening 2 through which brush members 3*a* of a rotary brush 3 project slightly toward the floor surface. The rotary brush 3 has ridges and furrows extending in a spiral form in axial direction thereof and brush member 3*a* are implanted into the ridges along their lengths. The rotary brush 3 is driven by a motor 4 via a belt 5 which in turn is driven and controlled by a control circuit 6. Wheels 9 carry the main body of the power brush built in the casing 1 and serves to maintain the casing 1 at a predetermined height on the floor surface as well as to form a flow path for sucked air into the opening 2. Dust and air sucked through the opening 2 are directed to a hose-mounting portion 8, slightly tapered at its tip end, and are delivered into the cleaner body through a flexible hose, not shown, to be connected to the hose-mounting portion 8. The electric power for the power brush is supplied through a connector 10.

In the case where the carpeted floor is cleaned by the power brush, the motor is operated to drive the rotary brush 3 into rotation so that dust between fuzzy hairs or texture of the carpet is brushed out by the brush member 3*a* and is sucked together with air into the hose. Thus cleaning is effected. In the case where the hard flat floor is to be cleaned, the rotary brush 3 is not driven but air is merely sucked.

A person using this type of power brush, therefore, has to watch the floor at all times to manually turn on the motor when the cleaner moves onto the carpeted floor, and to turn it off when it is on the panel floor. This manual switching is a nuisance for the operator. Because of this, the operator may wish to lift the cleaner to carry around from one place to another, across a hard, flat floor while the motor is running. The idle operation of the motor, however, is not only dangerous but also a waste of electric power. In Japanese houses where the hard, panel floor and the carpeted floor coexist, it is a serious problem to frequently switch on and off the power brush motor. Improvement has been long waited.

FIG. 16 illustrates another prior art vacuum cleaner disclosed in Japanese Utility Model Publication No. 58-17588 and FIG. 17 shows a floor detector used for the cleaner. In FIGS. 16 and 17, when a power switch is turned on, a motor within a body 61 runs to drive a rotating cleaning member, not shown, in contact with a floor surface 11, thereby effecting cleaning. When the body 1 is lifted, a shaft 65 displaces relative to an elongated hole 66 due to the weight of the wheel 64. As a result, an actuator 63 is allowed to further project, causing a safety switch 60 to become opened. In this manner, lifting the body 61 automatically causes rotation of the cleaning member to stop, thus eliminating the potential of contact accidents between the rotating cleaning member and the operator's body.

This type of apparatus, however, suffers from drawbacks in that dirt and dust from the floor easily adheres to the actuator of the safety switch, disturbing the smooth open and close operation of the switch. Moreover a mechanical contact of the switch can be a source of chattering of the switch due to the bounce of the contacts.

The fact that the actuator is operated by the weight of the wheel 64 causes another shortcoming. That is, when the body is lifted and turned its bottom side up for inspection, etc., the shaft 65 slides toward top side of the body in the elongated hole. The shaft 65 again pushes the actuator to activate it, causing the rotating cleaning member to suddenly rotate. Thus rotating cleaning member may injure operator's fingers or hands.

SUMMARY OF THE INVENTION

An object of the present invention is to provide a power brush in which the rotation of the brush member is automatically permitted or inhibited in accordance with the physical condition of the floor, i.e., relatively soft floor surfaces, for example, a carpeted floor, or relatively the flat, hard floor surfaces, for example, pass ways, and corridors.

A floor detector for a power brush of a vacuum cleaner comprises a lift sensor S1 and a floor sensor S2. The lift sensor S1 has a movable member which yieldably displaces when the power brush is placed on a relatively soft floor while the floor sensor S2 has a movable member which yieldably displaces when the power brush is placed on a relatively hard floor. Each of movable members is detected its movement by a corresponding light sensor which provides a signal representative of the movements. The signals from the light sensors are sent to a control circuit which controls a drive source for driving the brush member of the power brush. In this manner, the brush member is rotated when the power brush is placed on a relatively soft floor such as a carpeted floor and is not rotated when the power brush is placed on a relatively hard, flat, smooth floor.

BRIEF DESCRIPTION OF THE DRAWINGS

Feature and other objects of the invention will be apparent from the description of preferred embodiments with reference to the accompanying drawings in which.

DESCRIPTION OF PREFERRED EMBODIMENTS

Embodiment of the floor detector

Figure 1A:
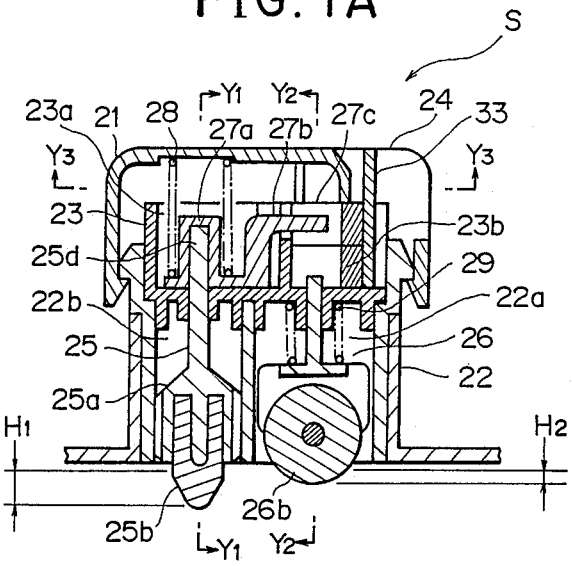
FIG. 1A shows a longitudinal cross-sectional view of a floor detector according to the present invention.
Figure 1B:
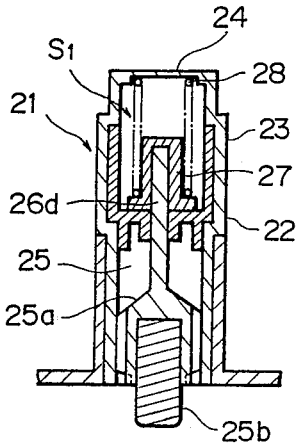
FIG. 1B shows a cross-sectional view taken along Y1—Y1 line in FIG. 1A.
Figure 1C:
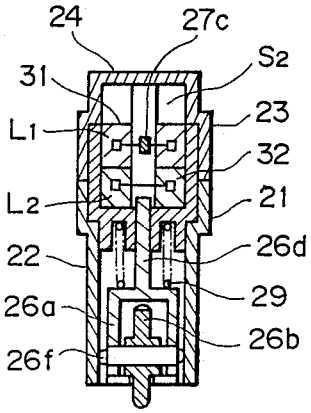
FIG. 1C shows a cross-sectional view taken along Y2—Y2 line in FIG. 1A.
Figure 1D:
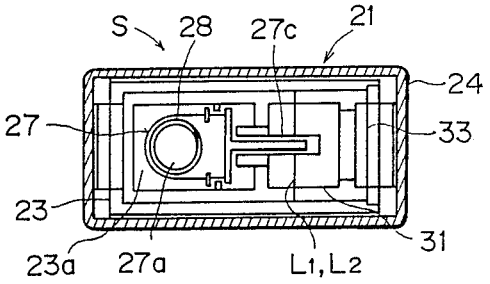
FIG. 1D illustrates a top cross-sectional view taken along Y3—Y3 line in FIG. 1A.
Figure 1E:
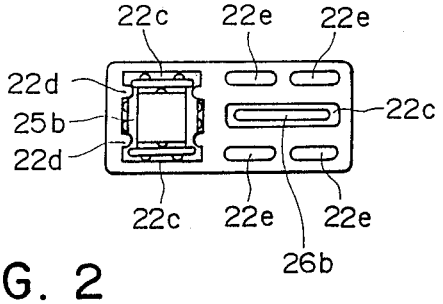
FIG. 1E shows a bottom view of the floor detector of the invention.
Figure 2:
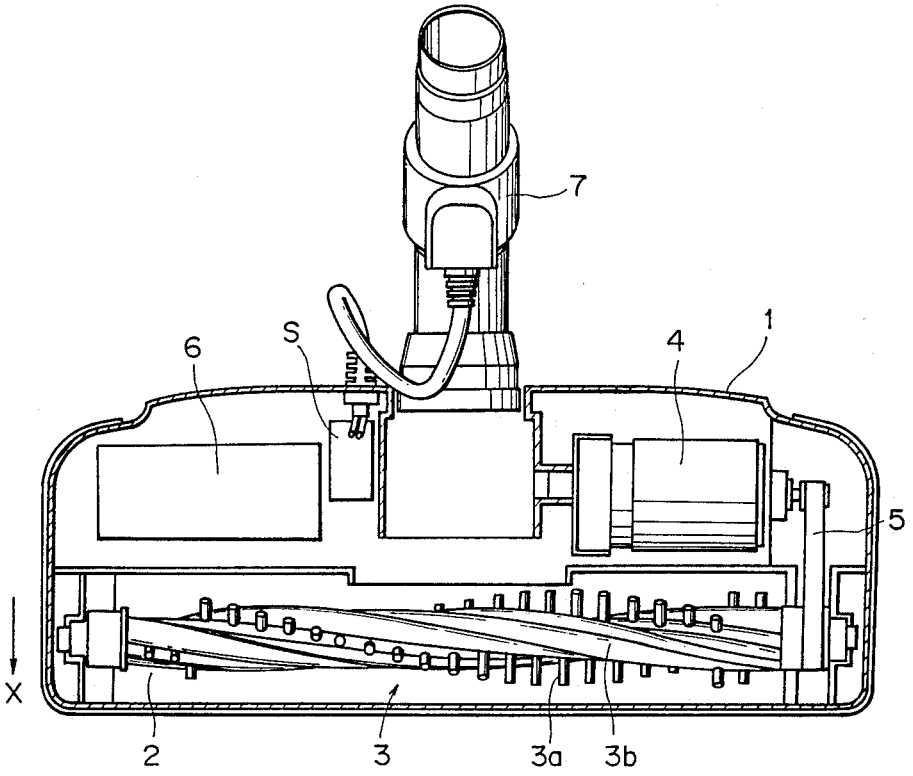
FIG. 2 shows a top view of a power brush to which a floor detector according to the invention is applied.
Figure 3:
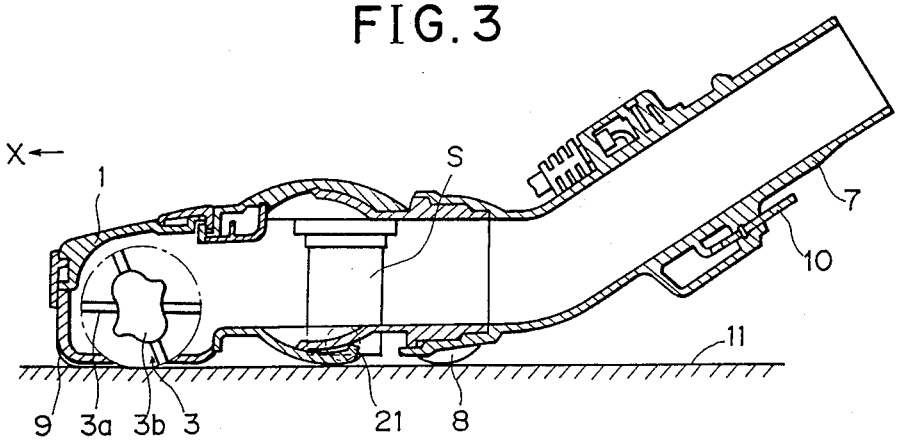
FIG. 3 shows a side view of the power brush, equipped with a floor detector according to the invention, when the power brush is placed on the floor.
Figure 4:
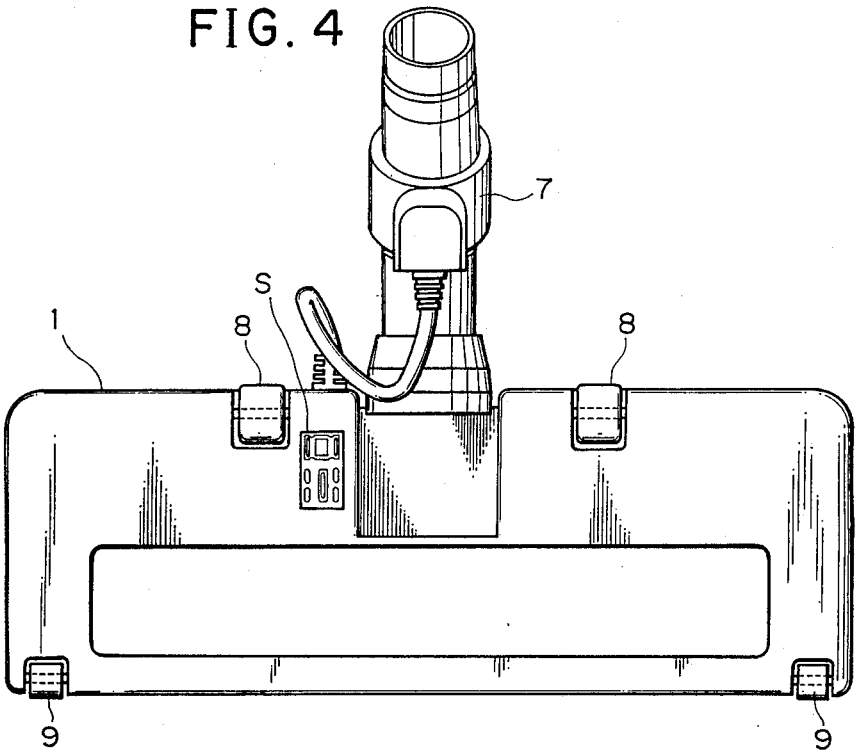
FIG. 4 shows a top view of FIG. 3.

FIG. 1A shows a longitudinal cross-sectional view of a floor detector according to the present invention; FIG. 1B shows a cross-sectional view taken along Y1—Y1 line in FIG. 1A; FIG. 1C shows a cross-sectional view taken along Y2—Y2 line in FIG. 1A; FIG. 1D illustrates a top cross-sectional view taken along Y3—Y3 line in FIG. 1A; FIG. 1E shows a bottom view of the floor detector of the invention; FIG. 2 shows a top view of a power brush to which the floor detector according to the invention is applied; FIG. 3 shows a side view of the power brush, equipped with the floor detector according to the invention when the power brush is placed on a floor. A mark "X" in the figures denotes the direction of the movement of the power brush.

Figure 6:
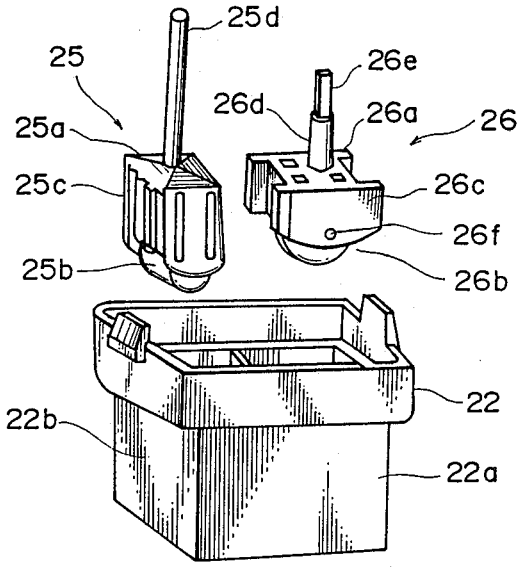

In FIGS. 1A–1C, the housing of the floor detector S according to the invention is formed in a shape of a substantially rectangular box and consists of a lower frame 22, a middle frame 23, and an upper cover 24 for covering the frame 22 and the frame 23. Defined by the lower frame 22 are a chamber 22*a* and a chamber 22*b*. A chamber 23*a* and a chamber 23*b* are defined by the middle frame 23. A movable member 25 consists of a contact 25*b*, a holder 25*a* for holding the contact 25*b*, and a column 25*d* upwardly extending through the middle frame 23, and is vertically slidable within the chamber 22*b*. As shown in FIG. 6, the holder 25*a* has formed thereon a plurality of vertically extending ribs which slides in contact with the inner wall of the lower frame 22 to smoothly guide the movable member 25 without excessive play or friction. The ribs also serve to provide some clearance between the inner wall of the lower frame 22 for dust to drop off therethrough even when the dust invades the chamber 22*b*.

The contact 25*b* is formed of a non-rotating member, corners of which being chamfered with about 3R, and width of which being about eight mm. The contact 25*b* may also be a rotating member.

A connecting piece 27 is formed os synthetic resin of a dark color (e.g. black), and is disposed within the chamber 23*a* defined by the middle frame 23. A tip end of the column 25*d* extends into a hollow cylindrical portion 27*a* of the connecting piece 27 in press fit engagement. Mounted on the periphery of the hollow cylindrical portion 27*a* is a coil spring 28 for urging the contact 25*b* so that the contact 25*b* projects through the bottom of the housing toward the floor surface. A bent portion 27*b* extends horizontally into the chamber 23*b* the tip end of which forming a light intercepting portion 27*c*. The urging force of the coil spring 28 is in the range of 50 to 300 g and the spring constant thereof is of a relatively small value so that the movable member 25 can sense the floor surface exhibiting a sufficient displacement in accordance with the surface roughness of the floor.

The movable member 26 consists of a contact 26*b*, a holder 26*a* for holding the contact 26*b*, and a column 26*d* extending through the middle frame 23, and is vertically movable within the chamber 22*a*. Mounted on the periphery of the column 26*d* is a coil spring 29 for urging the contact 26*b* to project through the bottom of the housing toward the floor surface. As is apparent from FIG. 1A, the contact 25*b* projects further than the contact 26*b*. The depressive force of the coil spring 29 is in the range of 50 to 300 g, the spring constant of which being selected to be large as compared to that of the coil spring 28. The end portion of the column 26*d* has formed a flat surface thereon as shown in FIG. 6 which forms a light intercepting portion 26*e*. the contact 26*d* is in the form of a wheel having a width of about 2 mm and a diameter of approximately 14 mm which rotates about a thin shaft 26*f* supported by a holder 26*a*. Depending on the quality and types of the carpets, the width of the wheel is selected to be in the range of 1–3 mm and the diameter thereof is selected to be in the range from 5 to 25 mm as required.

The surfaces of the inner walls of the lower frame 22 and the middle frame 23 that form the chambers 22*a*, 22*b* are coated an electrically conductive material to prevent static charge. The holders 25*a*, 26*a* are also coated the same conductive material thereon. The surface resistance of the coated walls and holders is in the order of 10 Meg ohms.

As shown in FIG. 1E, in the lower frame 22 are provided through-holes 22*c* for allowing the movable members 25,26 to project downwardly, escape holes 22*e* for the dust and sand that tend to be trapped to drop off therethrough, and limiting claws 22*d* for limiting the maximum downward movement of the movable member 25.

Non-contact type light sensors 31,32, which detect the vertical displacements of the movable members 25,26 are disposed, one stacked over the other, within the chamber **23*b***.

Figure 5:
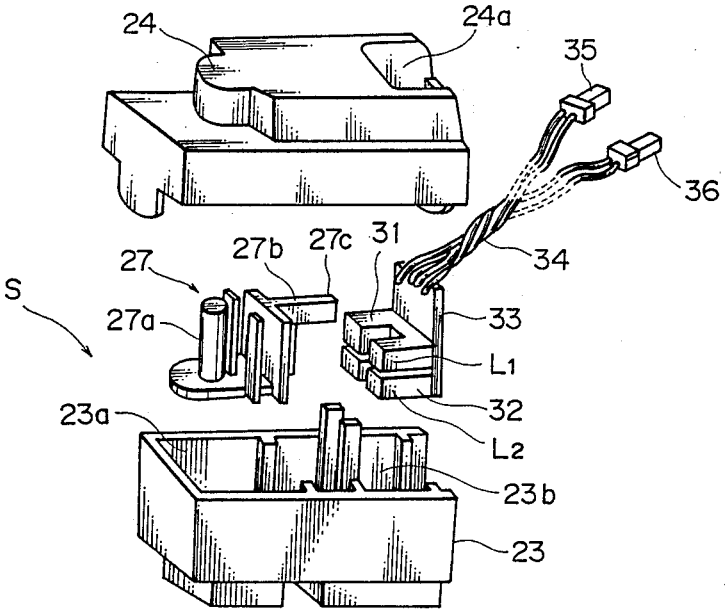
FIG. 5 and FIG. 6 illustrate an exploded perspective view of a floor detector according to the present invention.
Figure 11A:
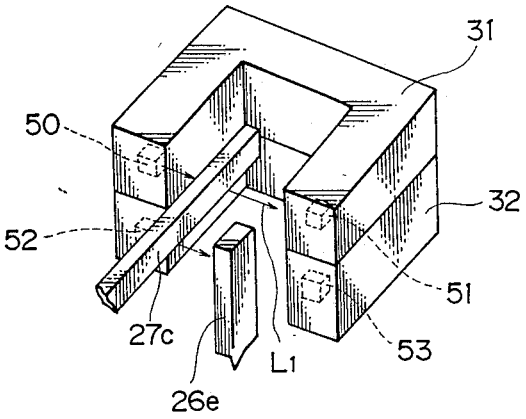
FIG. 11A illustrates the light sensor 32 with its light path L2 blocked and the light sensor 31 with its light path L1 cleared.
Figure 11B:
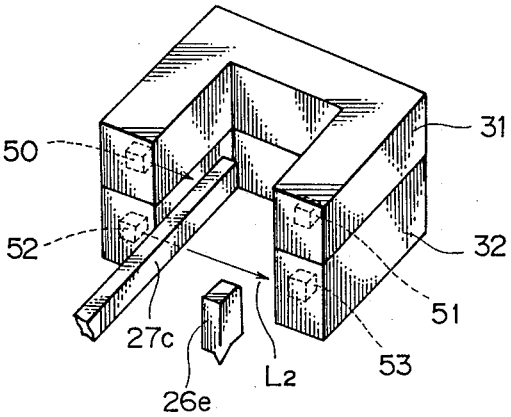
FIG. 11B shows the light sensor 32 with its light path L2 cleared and the light sensor 31 with its light path L1 blocked.

As shown in FIG. 5 and FIGS. 11A and 11B, the light sensors 31,32 are of the same substantially U-shaped construction having light emitting elements 50,52, respectively and light receiving elements 51,53 disposed at free ends of the U shape, each light emitting element horizontally opposing the corresponding light receiving element. In the gap between the free ends of the U-shaped light sensor 32 is inserted the light intercepting portion **26*e*. In the gap between the free ends of the sensor 31 is inserted the light intercepting portion 27*c*. The movable member 25 is urged downwardly by the coil spring 28 at all times, and the upward movement of the movable member 25 causes the light intercepting portion 27*c* to pass the light through the light path L1 while the downward movement causes the light intercepting portion 27*c* to block the light through the light path L1. In the mean time, the movable member 26 is urged downwardly by the coil spring 29 at all times, and the upward movement of the movable member 26 causes the light intercepting portion 26*e* to block the light through the light path L2 while the downward movement causes the light intercepting portion 26*e* to pass the light through the light path L1. Light emitting diodes are used for the light emitting elements of the light sensors 31,32** while photo diodes, which convert the light into electrical signals, are used for the light receiving elements. These photo diodes are connected in series.

The light sensors 31,32 are mounted on a printed circuit board 33 to which lead wires 34 are connected for directing the electrical signals form the light sensors to external circuits. On the ends of the lead wires 34 are connected connectors 35,36 for facilitating wiring to the external circuits. The lead wires are drawn out through a hole **24*a* in the upper cover 24. The printed circuit board 33 integral with these light sensors 31,32 is releasably inserted into the chamber 23*b*** from above.

The movable member 25 and the light sensor 31 forms a lift sensor S1 for sensing whether the power brush is placed on a floor or it is lifted up while the movable member 26 and the light sensor 32 forms a floor sensor S2 for sensing whether the power brush is placed on a flat, hard floor or it is placed on a soft floor, e.g., a carpeted floor. A combination of the lift sensor S1 and the floor sensor S2 forms a floor detector S according to the present invention.

OPERATION OF THE FLOOR DETECTOR

The operation of a power brush equipped with a floor detector S of the above described construction according to the invention will now be described.

FIGS. 1A–1C show the power brush when it is lifted up from the floor. The movable members 25,26 are each urged by the coil springs 28,29, respectively, the contacts **25*b*, 26*b* are at their lowest position of their vertical stroke, maintaining exposed lengths H1,H2, respectively. As shown in FIG. 11B, the light intercepting portion 27*c* which displaces together with the contact 25*b* is positioned in the light path L1 of the light sensor 31 to block the light, thereby detecting that the power brush is lifted up. In the mean time, the light intercepting portion 26*e* of the contact 26*b* is positioned below the light path L2 to pass the light. With this condition, the rotary brush 3** will not be driven into rotation.

Figure 9:
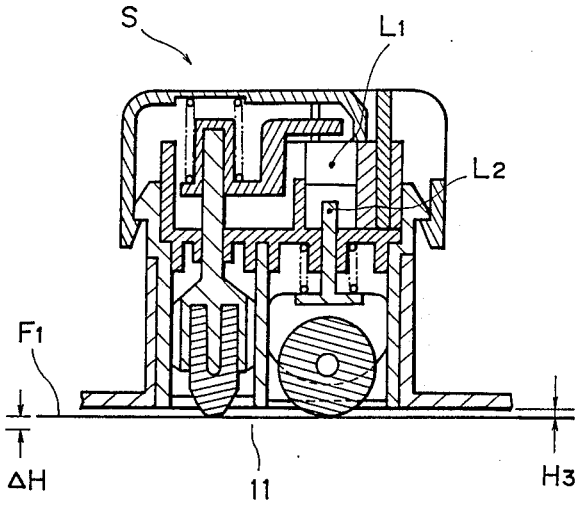
FIG. 9 shows the power brush in FIG. 8 placed on the flat, hard floor.

As shown in FIG. 9, when the power brush is placed on the floor surface 11, the floor sensor S2 will sense the floor in the following manner.

If the floor surface 11 is a hard, flat floor F1, as the power brush is placed on the floor surface 11, rollers 8,9 support the power brush above the floor surface, leaving a clearance H3 between the floor surface and the bottom of the floor detectors. The contact **25*b* being pushed up by the floor surface, the movable member 25 displaces upwardly by a large distance while the movable member 26 displaces by only a short distance because of the relative positions of the movable members 25, 26 when the springs 28, 29 are in their relaxed state. Thus the two contacts 25*b*, 26*b* are in contact with the hard, flat floor F1, maintaining the same clearance H3 between the floor surface and the bottom of the floor detector. At this time, as shown in FIG. 11A, the light path L1 of the light sensor 31 is not blocked while the light path L2 of the light sensor 32 is blocked. Therefore one of the two series-connected light receiving elements becomes non conductive, causing the rotary brush 3** to be inoperative.

At this time, if a switch located near a hose (not shown) is thrown into ON position, a motor for collecting dust starts to run, dust being sucked together with air through the air suction opening 2 and collected in the main body of the power brush.

Figure 8:
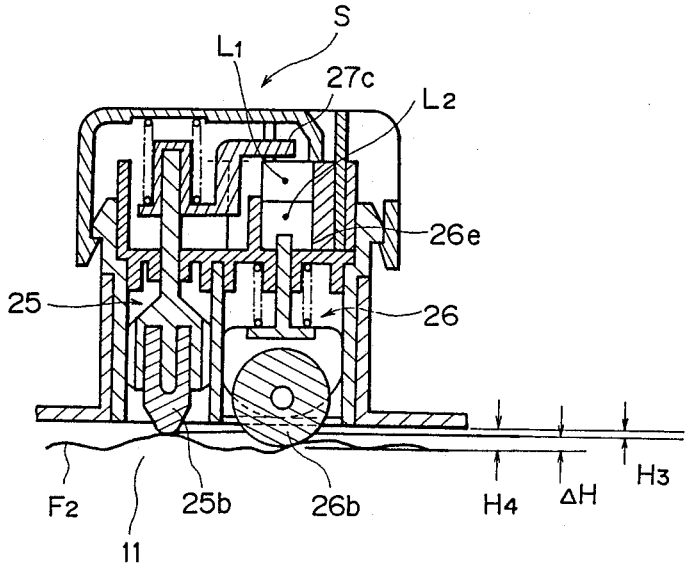
FIG. 8 shows a power brush, placed on the carpeted floor, to which a floor detector according to the invention is applied.

As shown in FIG. 8, when the power brush is moved from the hard, flat floor to the carpeted floor, the soft carpeted floor F2 is detected by the floor detector S2 in the following manner.

In a fashion similar to the case in FIG. 9, the rollers 8,9 of the power brush are supported above the floor surface. Depressing the soft surface of the carpet, the rollers 8,9 sink by a negligible distance as compared to when the power brush is placed on the hard, flat floor F1. The movable member 25 will not sink into fuzzy hairs or texture of the carpet and the contact **25*b* is exposed by the distance H3 out of the bottom of the casing since the contact 25*b* is depressed by only a small depressive force of the coil spring 28. On the other hand, the movable member 26 is given a strong depressive force by the coil spring 29, depressing the soft floor F2. In addition, the contact 26*b* depresses the soft carpet to sink into the gaps between the fuzzy hairs or texture, causing the exposing length of the contact 26*b* to increase by $\Delta H$, i.e., from H3 to H4**.

That is, the light intercepting portion **26*e* displaces downwardly significantly, thereby the sensor S2 sensing the carpeted floor. At this time, both the light paths L1 and L2 become open for causing the two series-connected light receiving elements of the light sensors 31,32 to conduct, thus transmitting a drive signal to a later described electrical circuit 6 in FIG. 2. This drive signal causes the motor 4 to drive the rotary brush 3 by means of the belt 5. Then the rotary brush 3, as in the prior art power brush, rotates to brush out the dust trapped between the texture or fuzzy hairs, which in turn is sucked together with air into the power brush main body. In this manner, the carpeted floor is detected by the sensor S2 and then the rotary brush 3 is automatically rotated to clean the carpeted floor. When the power brush again moves from the carpeted floor to the flat, hard floor, the movable members 26*b* and 25*b* return to the position shown in FIG. 9, and then the rotary brush 3** is automatically stopped to rotate.

Figure 10:
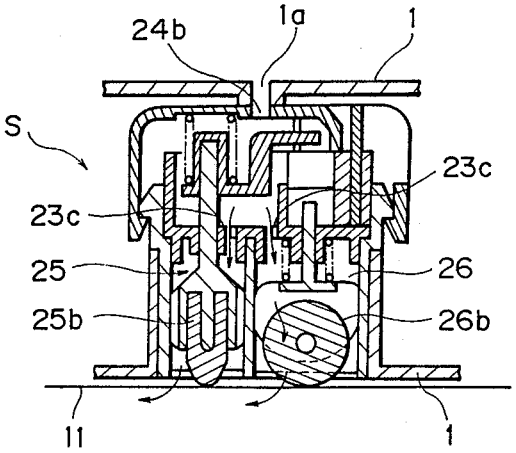
FIG. 10 shows a power brush provided with air vents in the casing, upper cover, and middle frame thereof.

As shown in FIG. 10, air vents 1*a*, 24*b*, and 23*c* may be provided in the casing 1, the upper cover 24, and the middle frame 23. Clean air near the top of the casing 1 is introduced through the passage defined by these air vents into the air suction opening 2. Thus the internal space of the floor detector may always be kept clean, preventing possible faulty operation due to trapped dust.

While the dust collecting motor incorporated in the main body is controlled in its on and off operation by means of the switch provided near the hose, the motor may be operated by the signal from the sensor S1 that senses whether the power brush is placed on the floor or lifted up from the floor. This alternative way of controlling the dust collecting motor can realize an energy saving type vacuum cleaner since the motor is prevented from idle rotation when the power brush is lifted up.

By properly selecting the width of the contacts and the spring constant of the coil spring 29, the floor detector can be arranged so that a variety of soft floor surfaces can be sensed.

By disposing a plurality of floor detectors, it is possible to arrange the floor detector so that various carpeted floors can be distinguished depending on the way they are manufactured and texture thereof.

EMBODIMENT OF THE POWER CONTROL CIRCUIT

The floor detector according to the present invention is controlled by a power controller circuit which operates on the basis of the signals from the described lift sensors S1 and floor S2 of the floor detector S.

Figure 7:
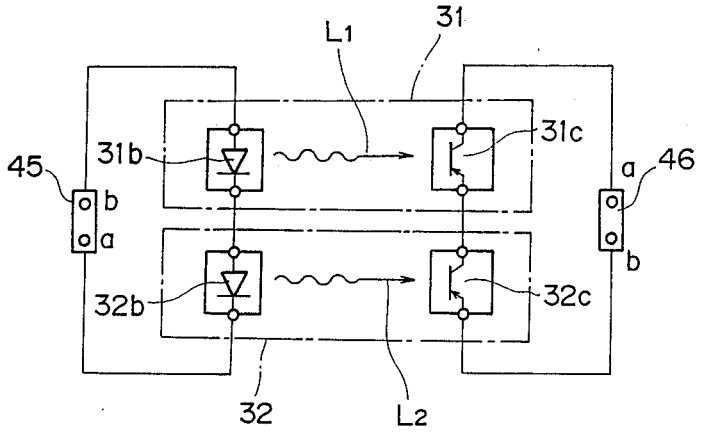
FIG. 7 is an electrical circuit of the light sensors according to the present invention.
Figure 12:
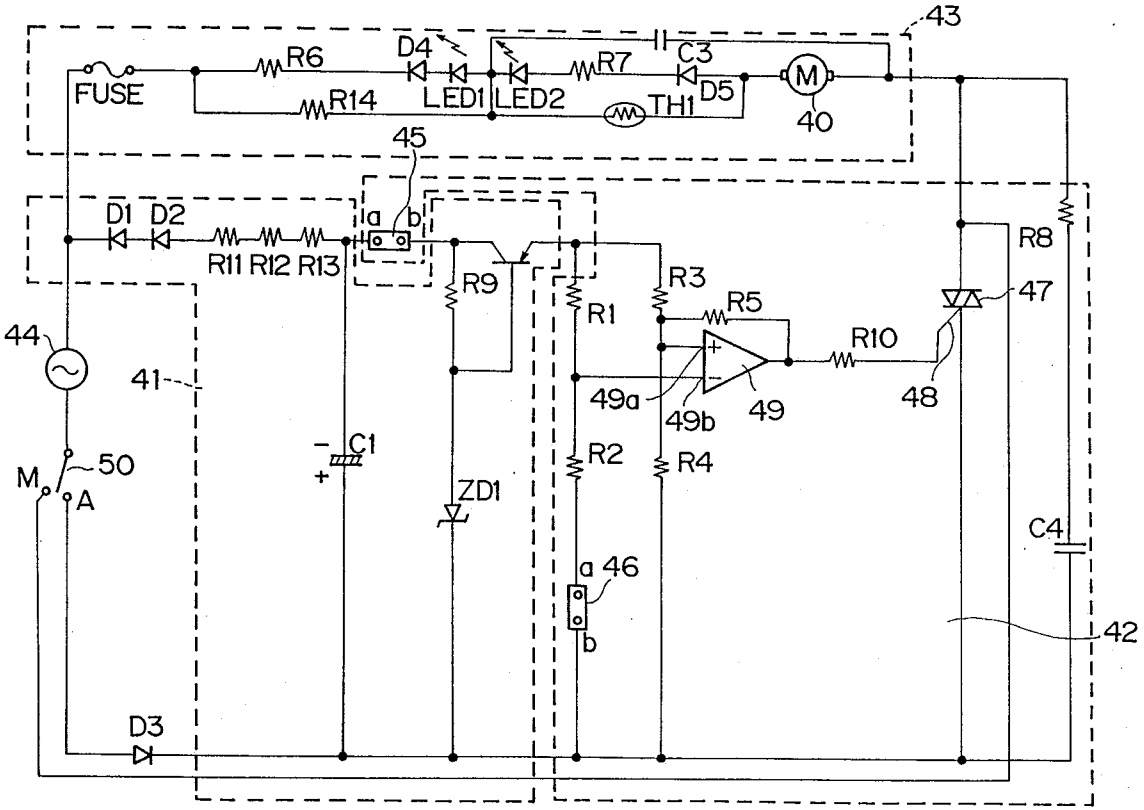
FIG. 12 is a schematic diagram of a power controller for the power brush to which the present invention is applied.

FIG. 12 is a schematic diagram of a power controller for a power brush to which a floor detector according to the present invention is applied. FIG. 7 is an electrical equivalent circuit of the light sensors 31,32. The power controller includes an on/off control circuit 42 for Triacs, a protection and LED circuit 43, and a dc supply circuit 41. The on/off control circuit 42 includes connectors 45,56 for the light emitting devices 31*b*, 32*b* and light receiving devices 31*c*, 32*c*. A selector switch 50 is operated to select operating modes of the rotary brush 3, i.e., the AUTO mode where the operation of the rotary brush 3 is controlled by the signal from the floor detector S or the MAN mode where on and off, operation of the brush 3 is controlled by the operator. The dc supply 41 receives an alternating current supply from an alternating power source 44 to provide a dc voltage of 15 volts, which is divided by a resistor R3 and a resistor R4 to produce a reference voltage. This reference voltage is input to a non-inverting input 49*a* of a comparator 49. A resistor R1, a resistor R2 and a connector 46 are connected in series and the junction point of the resistor R1 and the resistor R2 is connected to an inverting input 49*b* of the comparator 49. The series circuit of the light receiving elements 24*c*, 24*b* of the light sensors 31,32 is to be inserted between terminals of the connector 46. When both the light sensors 31,32 are ON, i.e., the terminals of the connector 46 are short-circuited, a voltage divided by the resistors R1 and R2 is applied to the inverting input terminal 49*b* of the voltage comparator 49, while when both the light sensors 31,32 are OFF, i.e., the terminals of the connector 46 are open-circuited, the voltage at the inverting input terminal 49*b* becomes lower by a voltage drop caused by a resistor R3.

By properly selecting the resistances of the resistors R1, R2, R3, and R4, the circuit can be arranged so that when the terminals of the connector 46 are short-circuited, the voltage at the inverting input terminal 49*b* is higher than that at the non-inverting input terminal 49*a*, and when the terminals are open-circuited, the voltage at the inverting input terminal 49*b* is lower than that at the inverting input terminal 49*a*. It turns out that when the voltage at the non-inverting input terminal 49*a* is higher than that at the inverting input terminal 49*b*, the Triac 47 is open, and when the voltage at the inverting input terminal 49*b* is higher than that at the non-inverting input terminal 49*a*, the Triac 47 becomes closed.

OPERATION OF THE CONTROL CIRCUIT

The operation of the control circuit will now be described below.

When the power brush is on the flat, hard floor, the photo switch 31*c* is ON and the photo switch 32*c* is OFF, causing the terminals of the connector 46 are open-circuited. Therefore the input voltage at the inverting terminal 49*b* of the voltage comparator 49 is lower than that at the non-inverting input terminal 49*a*. Thus the Triac 47 becomes OFF, causing the motor 4 to be de-energized to stop the rotary brush 3.

In contrast to this, when the power brush is on the soft, carpeted floor, the photo switch 31*c* and the photo switch 32*c* are both ON, causing the terminals of the connector 46 to be short-circuited. Therefore the input voltage at the inverting terminal 49*b* of the voltage comparator 49 is higher than that at the non-inverting input terminal 49*a*. As a result, the Triac 47 becomes ON, causing the motor 4 to be energized to drive the rotary brush into rotation. In other words, when the power brush is placed on the flat, hard floor, the rotary brush 3 is not be driven into rotation whereas when the power brush is placed on the carpeted floor, the rotary brush 3 is driven into rotation. In addition, during cleaning operation with the rotary brush 3 being rotated, if the power brush is lifted from the floor, then the photo switch 31*c* becomes OFF and the photo switch 32*c* becomes ON, causing the terminals of the connector 46 are open-circuited. This causes the Triac 47 to be open-circuited so that the motor 4 is de-energized to stop rotation of the rotary brush 3.

MODIFICATION TO THE POWER CONTROL CIRCUIT

If the floor has a local relief surface or there is a hole in the carpeted floor, then the wheel or the contacts of the floor detector falls into the relief or the hole to be trapped while cleaning operation is going on, causing changes in the information outputted from the floor detector. However, since the operator moves the power brush back and forth frequently during cleaning, the wheel or the contacts return to the previous position as soon as they escape from the "traps", thus causing the driving motor of the rotary brush 3 to be constantly switched back and forth between on and off operation. This affects the working life of the motor.

Figure 13:
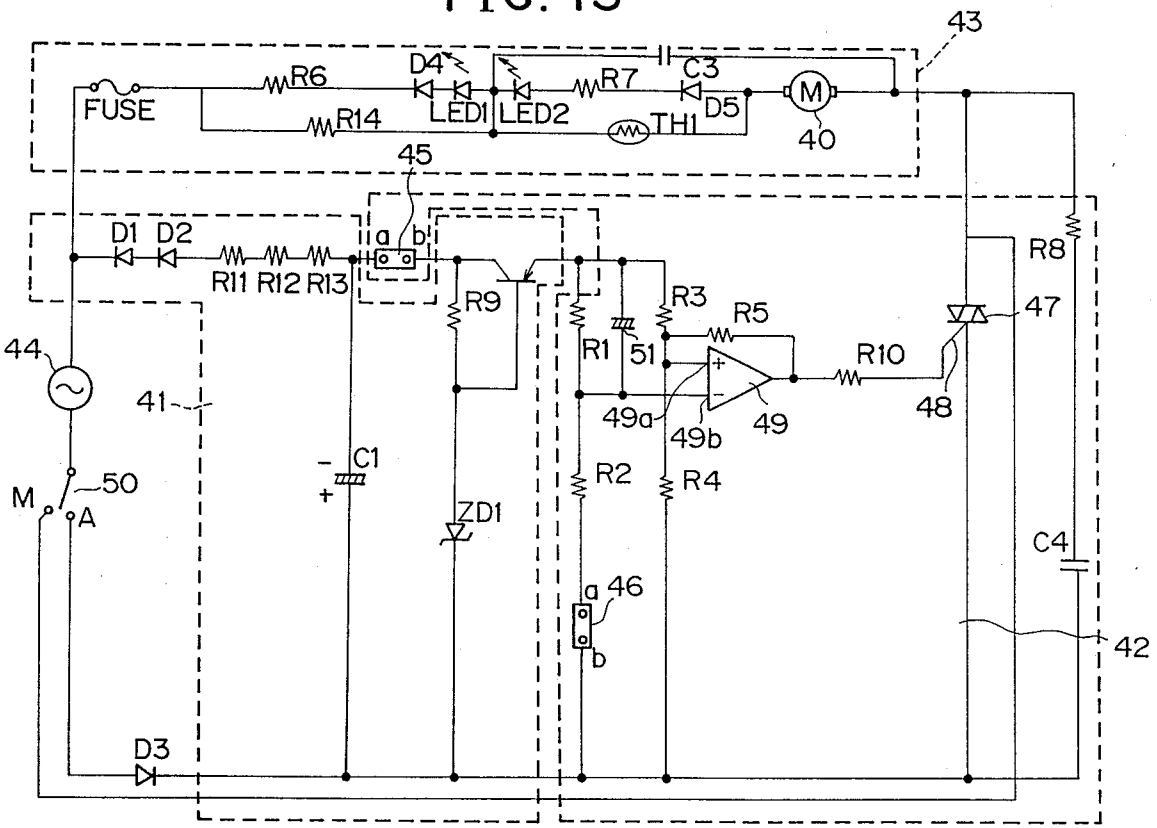
FIG. 13 shows a modified embodiment of the circuit in FIG. 12.
Figure 14:
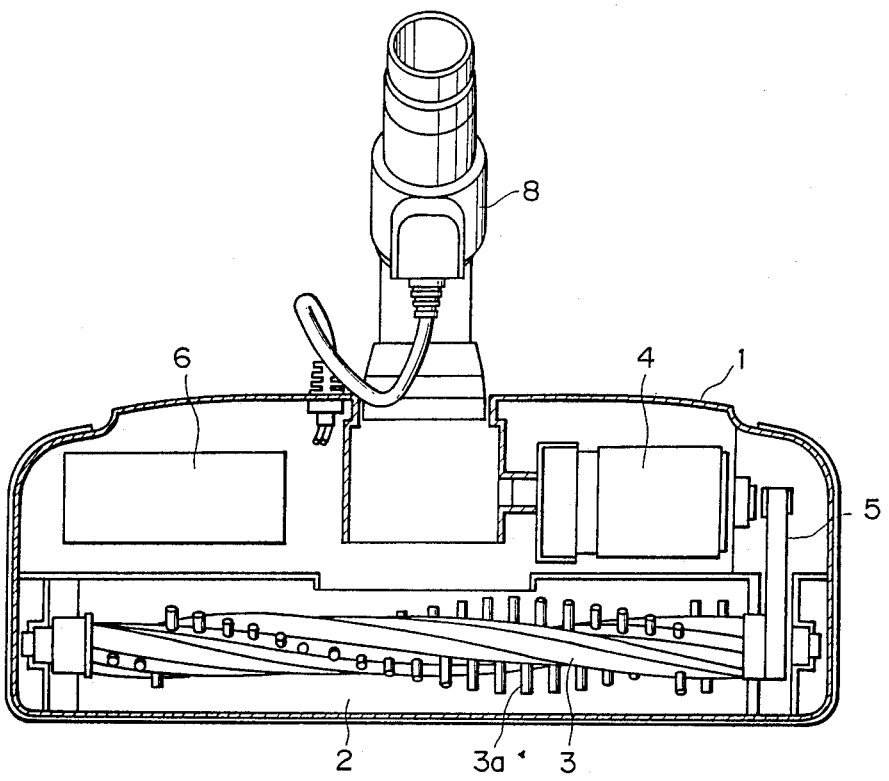
FIG. 14 PRIOR ART
FIG. 14 shows a top cross-sectional view of a prior art power brush.
Figure 15:
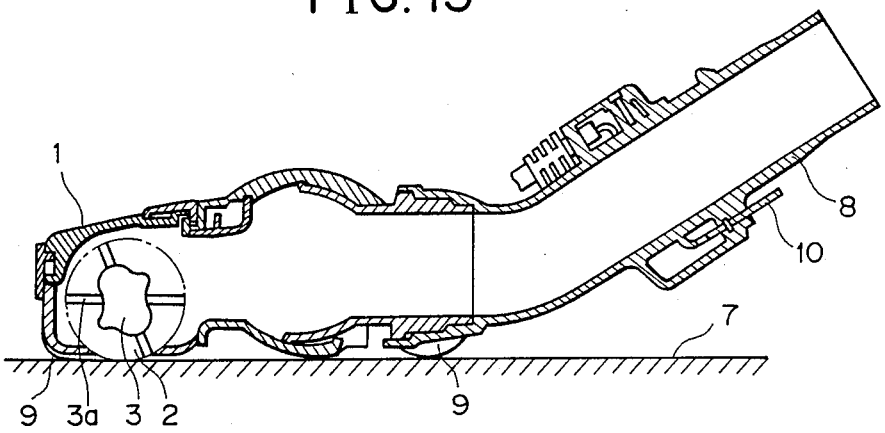
FIG. 15 illustrates a side view of the prior art brush when it is placed on a floor.
Figure 16:
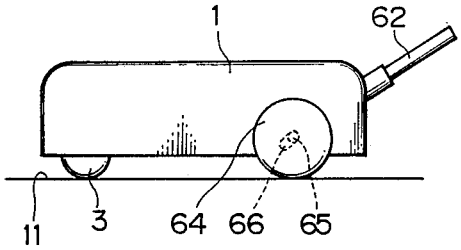
FIG. 16 PRIOR ART
FIG. 16 illustrates another prior art vacuum cleaner disclosed in Japanese Utility Model Publication No. 58-17588.
Figure 17:
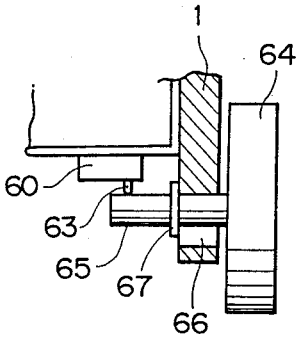
FIG. 17 PRIOR ART
FIG. 17 shows a floor detector used for the cleaner.

Thus, as shown in FIG. 13, by providing a capacitor 51 at the input of the voltage comparator 49 in the previously described control circuit, the brush can be controlled in such a way that the motor will be started only when the signal from the floor detector S lasts for a duration longer than a predetermined time, for example, 0.5 to 2 seconds. Then the rotary brush will not closely respond to momentary changes and the operation of the rotary brush remains unchanged if the changes disappear soon. In this manner, extremely sensitive operation of the rotary brush can be eliminated as well as malfunction of the motor due to frequent on and off operation of the motor can be prevented.

What is claimed is:

1. A floor detector for a power brush of a vacuum cleaner comprising:

a housing adapted to be mounted to said power brush;

a lift sensor (S1) having a first movable member (25) reciprocally movably housed in said housing, and a first spring (28) for urging said first movable member outwardly of said housing, said first spring having a first spring constant, said first movable member having a first contact projecting outwardly of said housing, said first contact causing said first movable member to yieldably displace when said power brush is placed on a floor;

a floor sensor (S2) having a second movable member (26) reciprocally movably housed in said housing and a second spring (29) for urging said second movable member outwardly of said housing, said second spring having a spring constant larger than said first spring constant of said first spring, said second movable member having a second contact projecting outwardly of said housing, said second contact causing said second movable member to yieldably displace vertically a first distance when said power brush is placed on a relatively hard floor and to yieldably displace vertically a second distance when said power brush is placed on a relatively soft floor;

a first displacement sensor (31) housed in said housing and detecting displacement of said first movable member;

a second displacement sensor (32) housed in said housing and detecting displacement of said second movable member; and control circuit means for correlating signals from said first and second displacement sensors to operate the power brush.

2. A floor detector for a power brush of a vacuum cleaner according to claim 1, wherein said first contact is formed to have a parabolic cross section taken along a direction of movement of the power brush and is formed of a soft synthetic resin material.

3. A floor detector for a power brush of a vacuum cleaner according to claim 1, wherein said second contact is a wheel which rotates to move in the direction in which the power brush moves.

4. A floor detector for a power brush of a vacuum cleaner according to claim 1, wherein said housing has inner walls which enclose said first movable member and said second movable member, and said inner walls being coated with an electrically conductive material thereover.

5. A floor detector for a power brush of a vacuum cleaner according to claim 1, wherein said housing is provided with holes through which dust and sand trapped therein can drop off onto the floor.

6. A floor detector for a power brush of a vacuum cleaner according to claim 1, wherein said first and second displacement sensors are of a non-contact type.

7. A floor detector for a power brush of a vacuum cleaner according to claim 6, wherein said first and second displacement sensors are light sensors.

8. A floor detector for a power brush of a vacuum cleaner according to claim 1, wherein each of said first and second displacement sensors has a light intercepting portion at a remote portion from said contact, which moves in one direction to cause said light paths of said light sensors to be blocked and in the other direction to cause said light paths of said light sensors to be opened when said movable sensors move vertically.

* * * * *